US007400299B2

(12) United States Patent
Ryken et al.

(10) Patent No.: US 7,400,299 B2
(45) Date of Patent: Jul. 15, 2008

(54) TEN INCH DIAMETER TM MICROSTRIP ANTENNA

(75) Inventors: Marvin L. Ryken, Oxnard, CA (US); Albert F. Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 190 days.

(21) Appl. No.: 11/527,643

(22) Filed: Sep. 21, 2006

(65) Prior Publication Data

US 2008/0074323 A1 Mar. 27, 2008

(51) Int. Cl.
*H01Q 1/38* (2006.01)

(52) U.S. Cl. ..... 343/700 MS; 343/708

(58) Field of Classification Search ..... 343/700 MS, 343/846, 705, 708
See application file for complete search history.

(56) References Cited

U.S. PATENT DOCUMENTS

| | | | | |
|---|---|---|---|---|
| 6,867,737 | B1 * | 3/2005 | Ryken et al. | 343/700 MS |
| 6,946,999 | B1 * | 9/2005 | Ryken et al. | 343/700 MS |
| 7,009,564 | B2 * | 3/2006 | Ryken et al. | 343/700 MS |
| 2003/0052828 | A1 * | 3/2003 | Scherzer et al. | 343/700 MS |
| 2003/0201937 | A1 * | 10/2003 | Lee | 343/700 MS |

* cited by examiner

*Primary Examiner*—HoangAnh T Le
(74) *Attorney, Agent, or Firm*—David S. Kalmbaugh

(57) ABSTRACT

A microstrip antenna configured to wrap around a projectile's body without interfering with the aerodynamic design of the projectile. The microstrip antenna has three identical conformal antenna elements equally spaced around the circumference of the projectile's body. The antenna has an operating frequency of 241.2 MHz or 231.0 MHz, a maximum diameter of ten inches and a maximum length of nine inches.

20 Claims, 5 Drawing Sheets

TEN INCH DIAMETER TM MICROSTRIP ANTENNA

BACKGROUND OF THE INVENTION

1. Field of the Invention

The present invention relates generally to a microstrip antenna for use on a weapons system to transmit telemetry data. More specifically, the present invention relates to a TM cylindrical shaped microstrip antenna array which transmits telemetry data and which is adapted for use on a 10-inch diameter weapons system such as a missile.

2. Description of the Prior Art

A microstrip antenna operates by resonating at a frequency. The conventional design uses printed circuit techniques to put a printed copper patch on the top of a layer of dielectric with a ground plane on the bottom of the dielectric. The frequency of operation of the conventional microstrip antenna is for the length of the antenna to be approximately a half-wavelength in the microstrip medium of dielectric below the patch and air above the patch. A quarter-wavelength microstrip antenna is similar to the half wavelength microstrip antenna except the resonant length is a quarter-wavelength and one side of the antenna is grounded.

There is currently a need to produce a quasi omni-directional radiation pattern to the front and rear of the antenna with circular polarization from a conformal wrap-around microstrip antenna with a 10-inch maximum diameter and 9-inch maximum length. The antenna is to be used on a weapons system or projectile such as a missile. The required frequency of operation for the antenna is 241.2 or 231.0 MHz.

SUMMARY OF THE INVENTION

The present invention overcomes some of the disadvantages of the past including those mentioned above in that it comprises a highly effective and efficient microstrip antenna designed to transmit telemetry data for use at a receiving station. The microstrip antenna comprising the present invention is configured to wrap around a projectile's body without interfering with the aerodynamic design of the projectile.

The microstrip antenna of the present invention has three identical conformal antenna elements equally spaced around the circumference of a projectile's body. The antenna has an operating frequency of 241.2 MHz or 231.0 MHz, a maximum diameter of ten inches and a maximum length of nine inches.

To achieve circular polarization, each of the three antenna elements are driven with an equal amplitude signal and a progressive 120 degree phase shift. A three way power divider is used to obtain the equal amplitude signals and the progressive 120 degree phase shift is obtained by proper length of the feed lines from the power divider to each of the three antenna elements.

DETAILED DESCRIPTION OF THE PREFERRED EMBODIMENT

Figure 1:
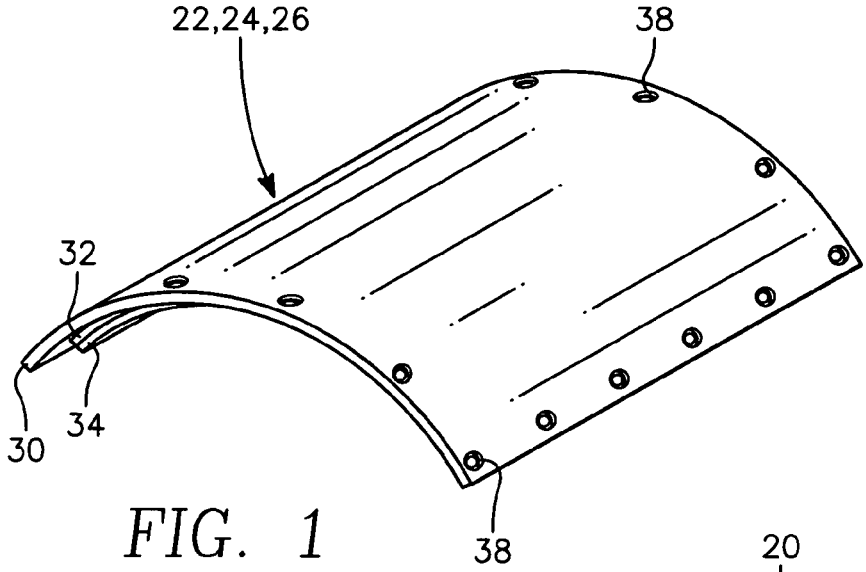
FIG. 1 is a perspective view of one of the three 120 degree TM microstrip antenna elements for the ten inch diameter TM microstrip antenna comprising the present invention.
Figure 2:
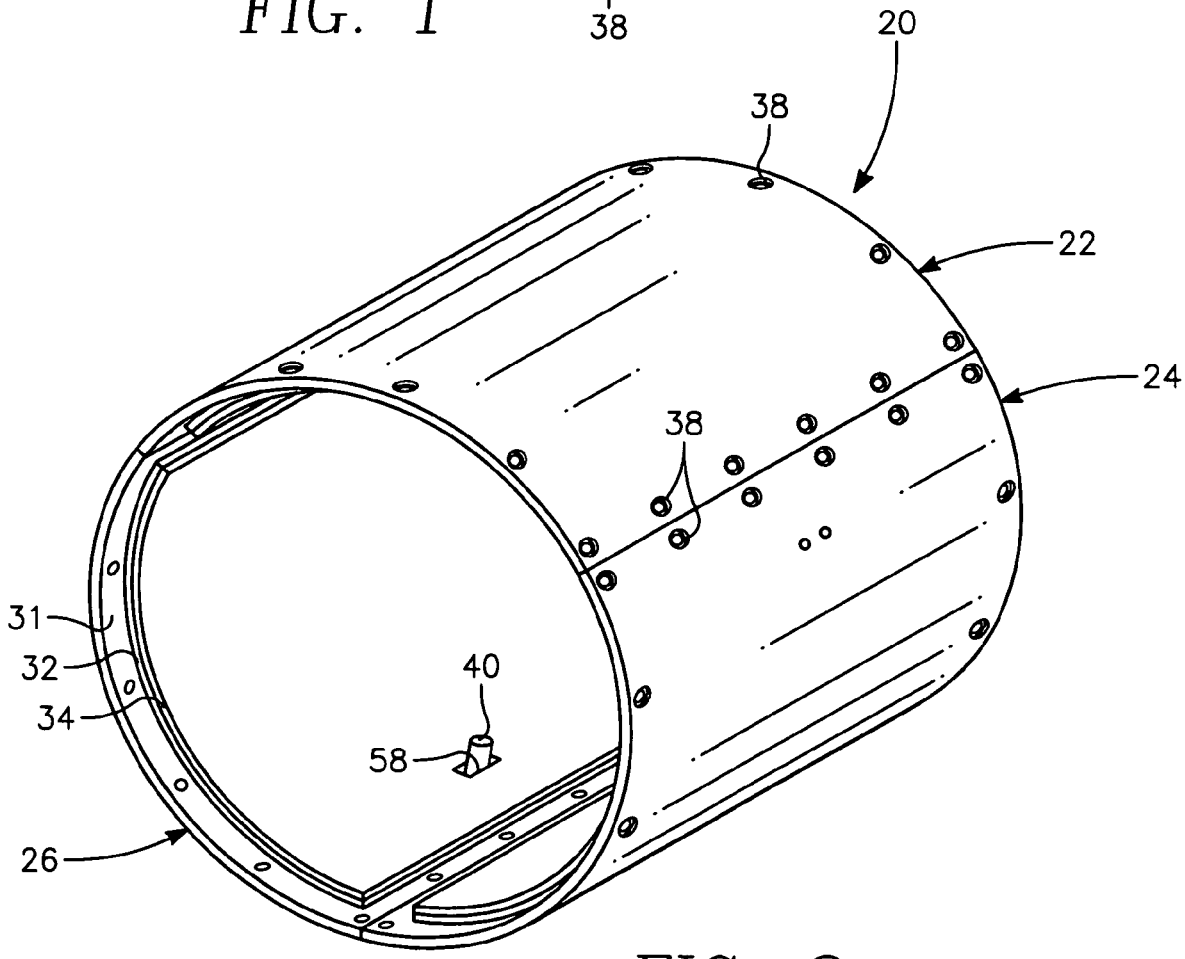
FIG. 2 is a perspective of the ten inch diameter TM microstrip antenna comprising the present invention.
Figure 3:
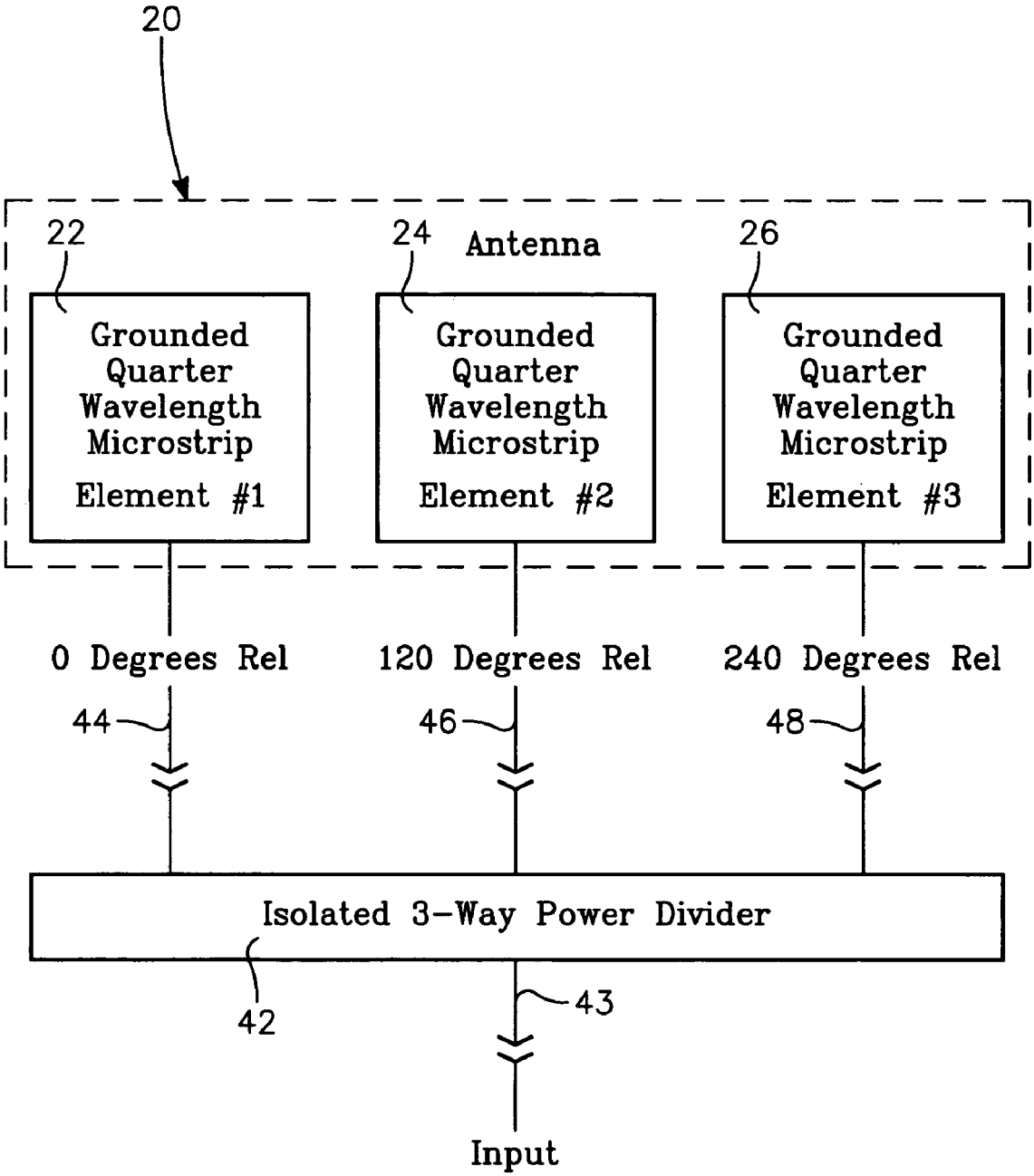
FIG. 3 is an electrical block diagram illustrating the antenna elements, power divider and feed lines for the TM microstrip antenna of FIG. 2.

Referring to FIGS. 1, 2 and 3, FIG. 2 illustrates a perspective view of the ten inch diameter TM microstrip antenna 20 which is adapted for use on a projectile such as a missile. Antenna 20 has three rectangular shaped identical 120-degree TM microstrip antenna elements 22, 24 and 26 which produce an omni-directional radiation pattern at the from and rear of antenna 20. Antenna 20 also has a maximum diameter of 10 inches, a thickness of 0.2 inches and a length of 8 inches. The required frequency of operation for antenna 20 is either 241.2 MHz or 231 MHz.

Antenna 20 comprises the three identical conformal antenna elements 22, 24 and 26 illustrated in FIG. 1, which are equally spaced around the circumference of the projectile. Due to the significantly large thickness of antenna 20, antenna was divided into three separate microstrip antenna elements. A single element antenna that wraps around the circumference of a projectile would not be flexible enough to bond or be installed on the projectile without cracking and deforming the printed radiating elements and feed lines and other circuitry on the circuit board of the microstrip antenna.

Referring to FIG. 1, each of three identical 120-degree TM microstrip antenna elements 22, 24 and 26 has three printed circuit boards layers. The outside Printed Circuit Board (PCB) layer 30 is a protective layer or cover for antenna 20. The outside layer 30 has a thickness of 0.062 inches and is fabricated from Rogers Corporation RT/5870. The middle PCB layer 32 is Circuit Printed Circuit Board and the inside PCB layer 34 is the Ground Printed Circuit Board. Both the Circuit and Ground Printed Circuit Boards are made from Rogers Corporation's Duriod RT/6002 with a 0.060-inch thickness clad with one-ounce copper. The material used for the Circuit and Ground Printed Circuit Boards 32 and 34, respectively, were selected because of their extremely stable properties with respect to temperature. Two layers are required because a thickness in excess of 0.060-inch would result in cracking when the Printed Circuit Boards 32 and 34 are bent into the configuration required for antenna 20.

Figure 4:
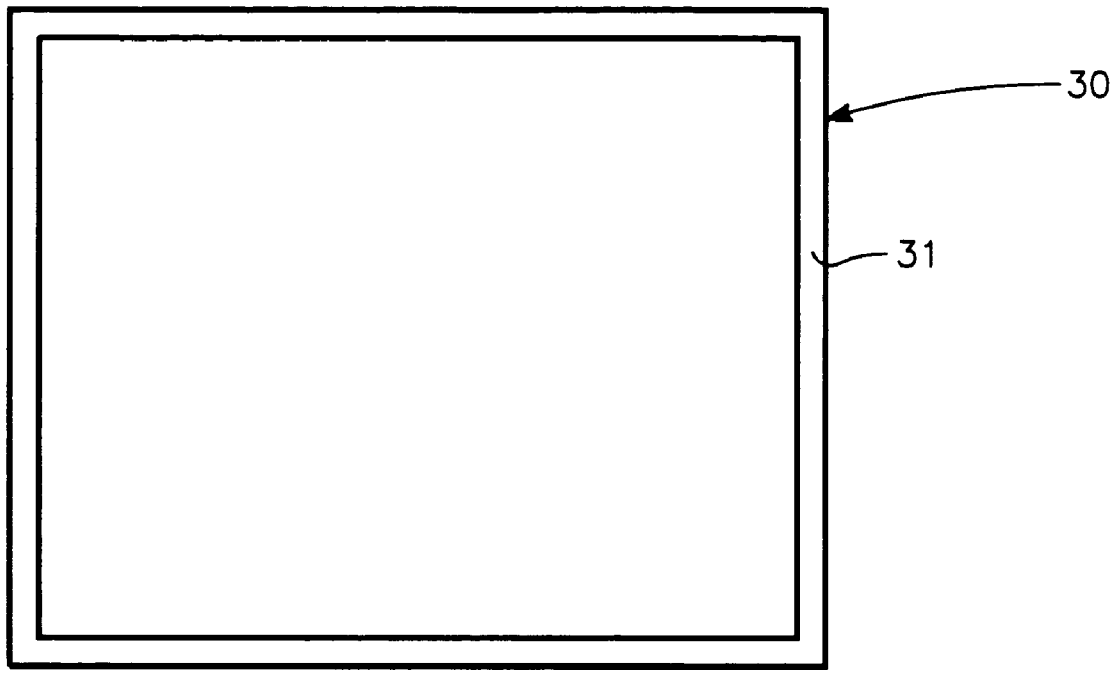
FIG. 4 is a view illustrating the bottom layer of the cover board for the TM microstrip antenna of FIG. 2.

Referring to FIGS. 2 and 4, each TM microstrip antenna 22, 24 and 26 has around its perimeter a plurality of mounting holes and their associated mounting screws 38 which secure each antenna element 22, 24 and 26 to the outer surface of the projectile. The bottom surface of cover board 30 has an area 31 which extends beyond boards 32 and 34. Area 31 allows an operator to attach the mounting screws through the cover board 30 to the projectile which secures the antenna elements 22, 24 and 26 to the projectile. Area 31 is strengthened and the ground plane reinforced with a copper layer as shown in FIG. 4. The upper surface of cover board 30 is clean.

Located on the inside of each antenna element 22, 24 and 26 of antenna 20 is a SMA female chassis mount cable connector 40, which supplies RF (radio frequency) electrical signal from the projectile to the antenna elements 22, 24 and 26. The cable connector 40 for each antenna element 22, 24 and 26 is a 50 ohm impedance matching connector.

Referring to FIG. 3, there is shown a block diagram for antenna 20 where equal amplitude of the RF electrical signals for each of the TM microstrip antenna 22, 24 and 26 is obtained from an isolated three way power divider 42. Power divider 42 is electrically connected to each of the three antenna elements 22, 24 and 26 by electrical transmission lines 44, 46 and 48, respectively. Electrical transmission lines 44, 46 and 48, which are electrical cables having different lengths, are configured to provide for a 120 degree progressive phase shaft. Thus, when the signal on line 44 is 0 degrees, the signal on line 46 will be 120 degrees and the signal on line 48 will be 360 degrees. To achieve the required circular polarization, each of the antenna elements 22, 24 and 26 of antenna 20 is driven with equal amplitude and a progressive 120 degree phase shift. There is also an input electrical transmission line 43 to the power divider.

Figure 5:
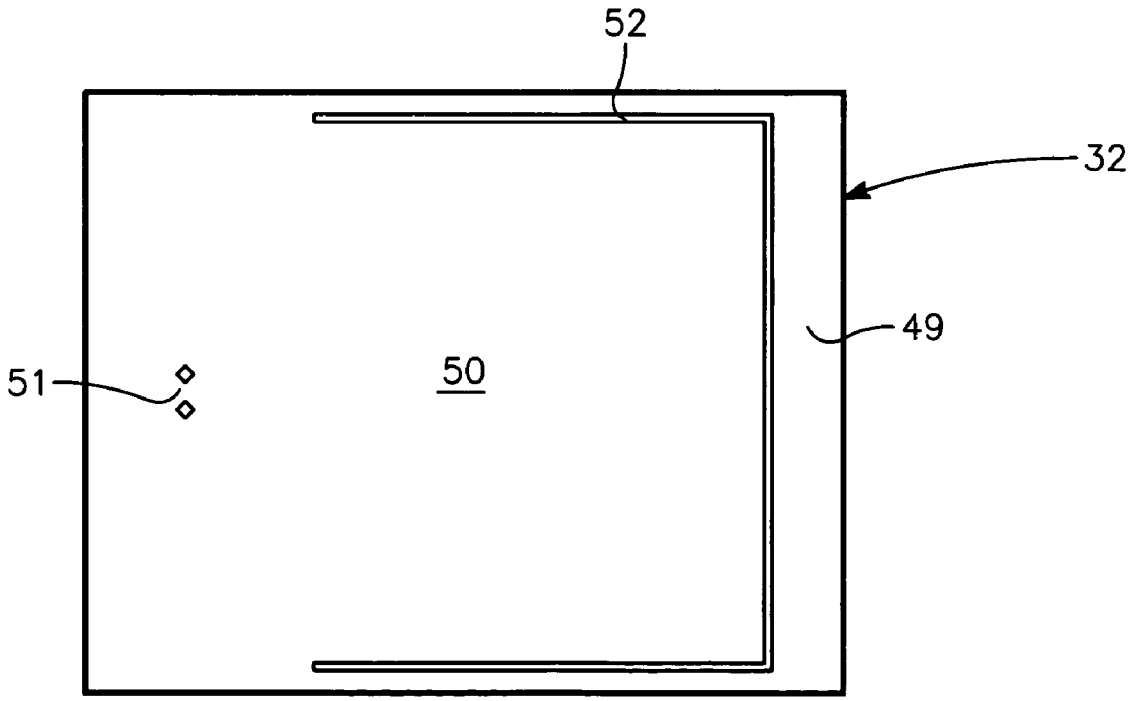
FIG. 5 is a view of the top layer of the circuit board for the TM microstrip antenna of FIG. 2 which includes the microstrip antenna element.

Referring to FIG. 5, each antenna element 22, 24 and 26 has a frequency determining grounded quarter wavelength resonator 50 formed from copper plating on the upper surface of circuit PCB 32. The quarter wavelength resonator 50 is the copper plated radiating element for antenna elements 22, 24 and 26. A three sided dielectric gap 52 is formed at the edge of resonator 50 with the antenna element's electric field being confined primarily to the dielectric gap 52. The length of the gap's sides on the upper surface of PCB 32 are configured so that antenna 20 operates as a quarter wavelength microstrip antenna. The quarter wavelength resonator 50 extends from the center of the gap 52 on the right side of PCB 32 to the left edge of PCB 32. The remaining copper plating 49 outside of the dielectric gap 52 is maintained at ground potential which provides the ground for the resonator 50.

The TM input 51 is located on the left side of the circuit PCB as shown in FIG. 5.

Figure 6:
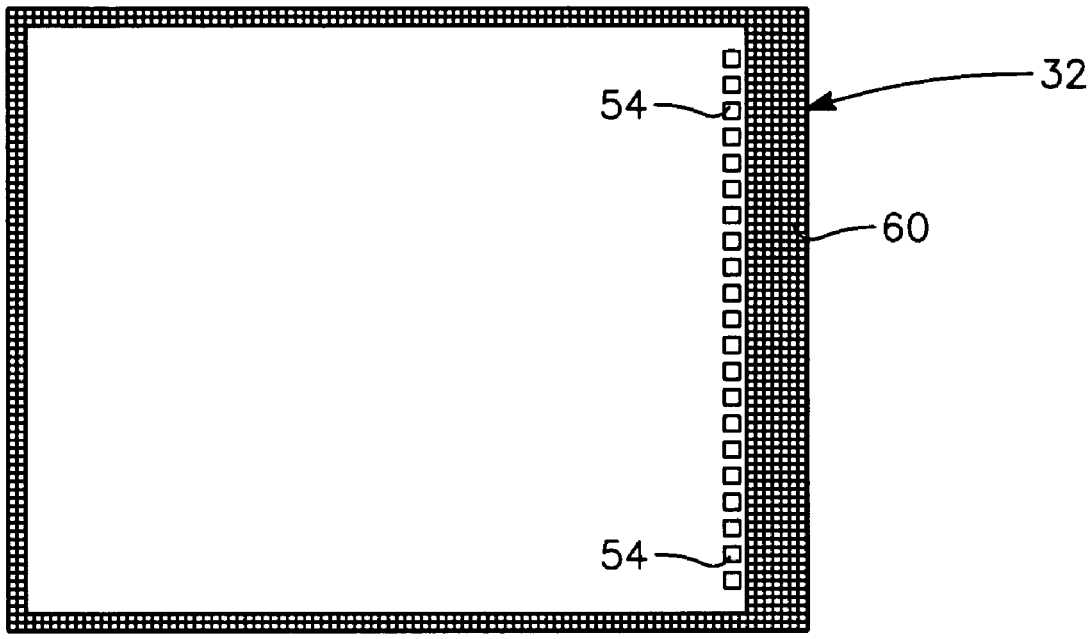
FIG. 6 is a view of the bottom layer of the circuit board for the TM microstrip antenna of FIG. 2.
Figure 7:
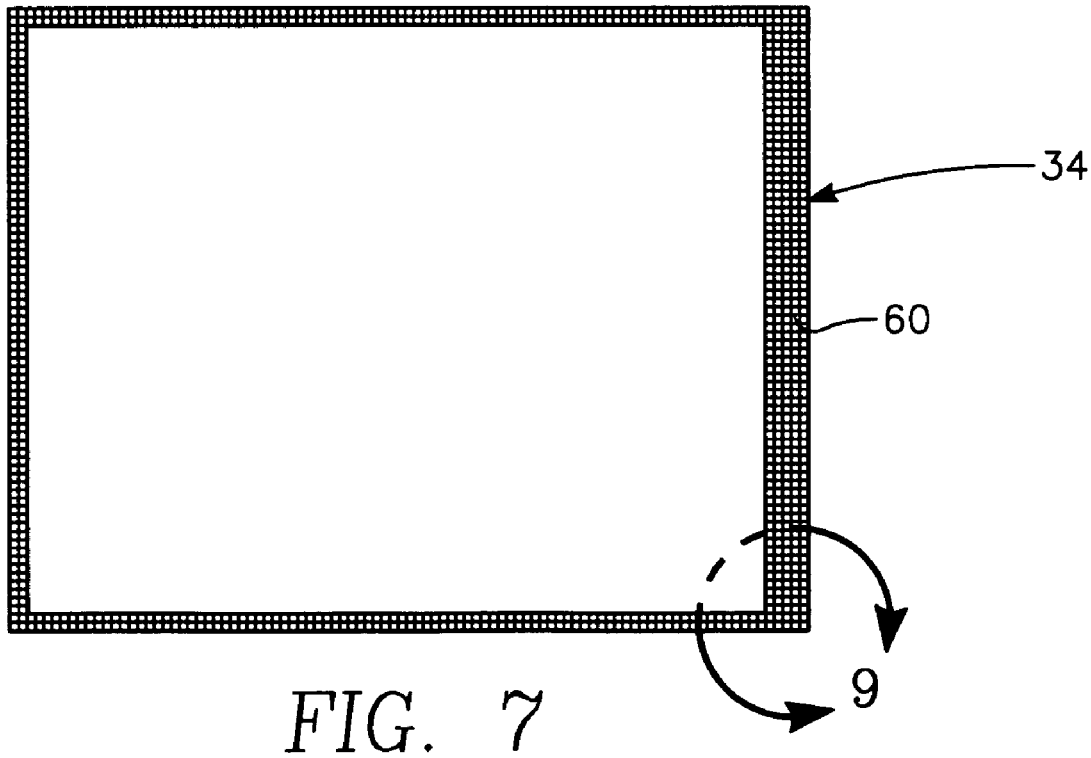
FIG. 7 is view of the top layer of the ground board for the TM microstrip antenna of FIG. 2.
Figure 8:
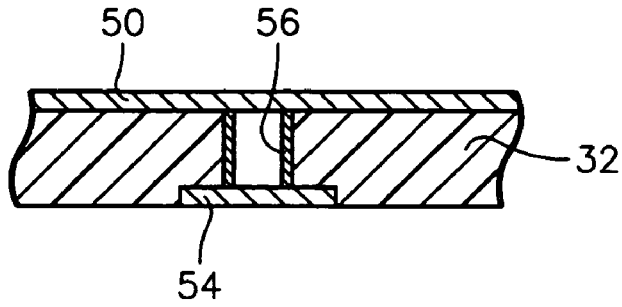
FIG. 8 is a sectional view of the circuit board which illustrates one of the tuning tabs and the via which connect the tuning tab to the quarter wavelength resonator on the upper surface of circuit board of FIG. 6.

Referring to FIGS. 6 and 8, the bottom of circuit PCB 32 has a plurality of tuning tabs 54 which are square copper patches are used to fine tune the operating frequency of microstrip antenna 20. Each tuning tab are copper shaped squares having dimensions of 0.201 inches by 0.201 inches. Each tuning tab 54 allows the TM microstrip antenna elements 22, 24 and 26 to be fine tuned by approximately 1.5 MHz.

Due to manufacturing tolerances of the antenna, tuning of the antenna's frequency to the operating frequency is required. As shown in FIG. 8, a plated through via 56 connects the tuning tab 56 to the quarter wavelength resonator 50. By drilling out the plated through hole 56, the tab 54 is disconnected from the quarter wavelength resonator 50 and a small amount of capacity is removed from the TM microstrip antenna 20. The reduction in capacity results in a change in the frequency of the TM microstrip antenna 20 tuning the frequency upward by approximately 1.5 MHz.

Referring to FIGS. 6, 7, 8 and 9, the bottom layer of ground PCB 34 is solid copper plating with a clearance hole 58 (FIG. 2) around the input. Clearance hole 58 is designed for cable connector 40. The top layer of ground PCB 34 which is depicted is virtually identical to the bottom layer of circuit PCB except it does not have the tuning square patches 54. The ground PCB 34 and the circuit PCB 32 have copper plated sides since PCB 32 and PCB 34 form the bulk of the antenna element's resonant structure. The copper plated sides provide the grounding for resonator 50 of each of the microstrip antenna elements 22, 24 and 26.

Figure 9:
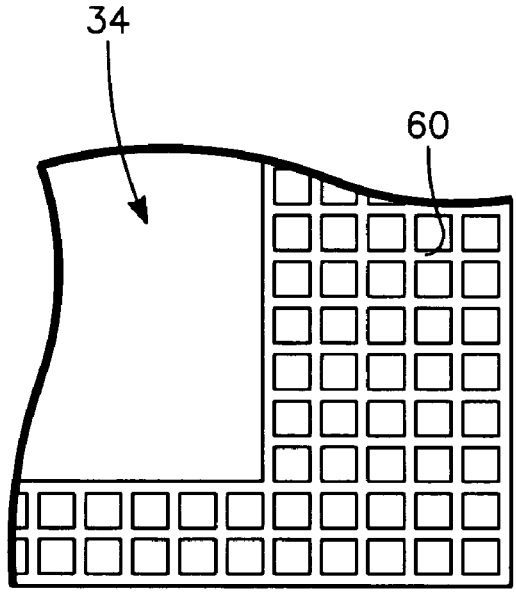
FIG. 9 is a view of the ground board taken along line 9-9 of FIG. 7.

Referring to FIGS. 1 and 9, the PCBs 30, 32 and 34 for each of the TM microstrip antenna elements 22, 24 and 26 are gold plated to protect the copper from environmental conditions and high bonding temperatures. The bottom layer of the circuit PCB 32 and the top layer ground PCB 34 each include near their edges a copper cross hatch pattern 60. FIG. 9 illustrates a portion of the copper cross hatch pattern 60 for the top layer of the ground PCB 34. The copper cross hatch pattern 60 for each of the PCBs 32 and 34 insure a solid bond between the printed circuit boards when the three rectangular shaped identical 120-degree TM microstrip antenna elements 22, 24 and 26 are assembled.

Figure 10:
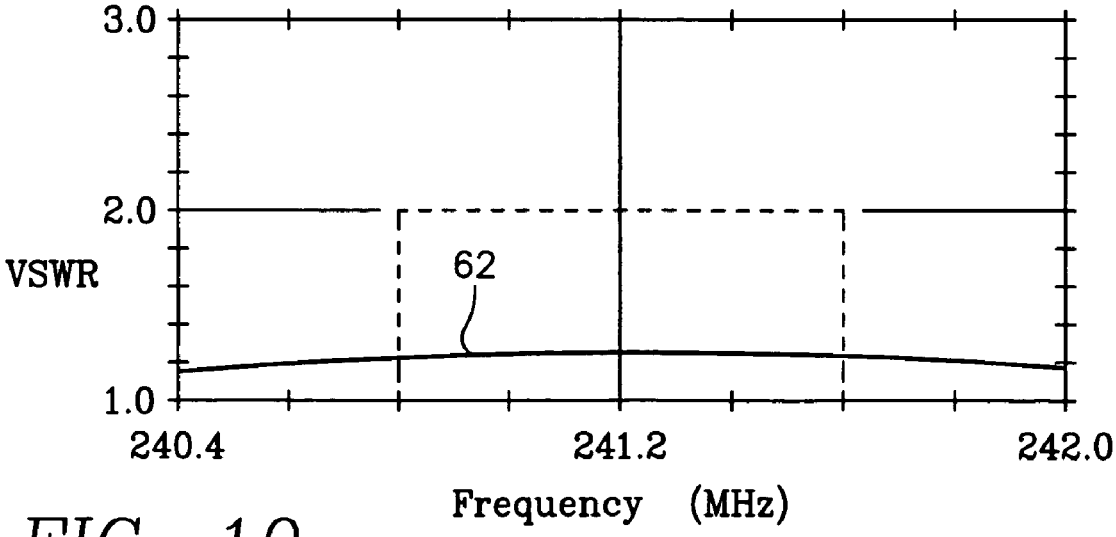
FIG. 10 is a typical voltage standing wave ratio plot for the microstrip antenna of FIG. 2.

Referring to FIG. 10, there is shown a Voltage Standing Wave Ratio (VSWR) plot 62 for ten inch diameter TM microstrip antenna 20. The VSWR plot 62 is less than 2:1 over most of the 240.4 MHz to 242.0 MHz frequency range which is within the operating frequency range of antenna 20. The VSWR of less than 2:1 is the result of the isolation of power divider 42.

From the foregoing, it is readily apparent that the present invention comprises a new, unique, and exceedingly useful TM microstrip antenna adapted for use on 10-inch diameter projectiles, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A TM microstrip antenna adapted for use on a projectile comprising:

(a) first, second and third rectangular shaped 120-degree TM microstrip antenna elements mounted on an outer surface of said projectile adjacent to one another, each of said first, second and third 120-degree TM microstrip antenna elements including:

(i) a first dielectric layer operating as a protective layer for each of said 120-degree TM microstrip antenna elements;

(ii) a second dielectric layer positioned below said first dielectric layer within each of said 120-degree TM microstrip antenna elements, said second dielectric layer having an upper surface and a lower surface;

(iii) a rectangular shaped copper quarter wavelength resonator mounted on the upper, surface of said second dielectric layer;

(iv) a continuous gap formed around one edge and two sides of said quarter wavelength resonator, said continuous gap being configured so that said TM microstrip antenna operates as a quarter wavelength microstrip antenna;

(v) a copper plated region formed outside of said gap on a remaining portion of the upper surface of said second dielectric layer, said copper plated region functioning as a ground for said quarter wavelength resonator;

(vi) a plurality of aligned tuning tabs mounted on the bottom surface of said second dielectric layer, each of said tuning tabs having a plated through via which passes through said second dielectric layer to said quarter wavelength resonator to connect said tuning tab to said quarter wavelength resonator;

(vii) a third dielectric layer positioned below said second dielectric layer within each of said 120-degree TM microstrip antenna elements, said third dielectric layer having an upper surface and a lower surface; and (viii) a copper plated ground plane mounted on the bottom surface of said third dielectric layer wherein said copper plated ground plane is connected to the copper plated region of said second dielectric layer grounding the copper plated region of said second dielectric layer; and (b) said first, second and third 120-degree TM microstrip antenna elements generating an omni-directional radiation pattern at the front and rear of said TM microstrip antenna at first and second operating frequencies; and (c) said first, second and third 120-degree TM microstrip antenna elements being driven by equal amplitude signals which are progressively phase shifted by one hundred twenty degrees to obtain circular polarization of the electromagnetic filed generated by said TM microstrip antenna.

2. The TM microstrip antenna of claim 1 wherein said first operating frequency for said TM microstrip antenna is 241.2 MHz.

3. The TM microstrip antenna of claim 1 wherein said second operating frequency for said TM microstrip antenna is 231.0 MHz.

4. The TM microstrip antenna of claim 1 wherein the operating frequency for said TM microstrip antenna is tuned by selectively removing the plated through vias from said second dielectric layer for each of said first, second and third 120-degree TM microstrip antenna elements.

5. The TM microstrip antenna of claim 1 wherein selective removal of said tuning tabs from the quarter wavelength resonator for said first, second and third 120-degree TM microstrip antenna elements fine tunes said TM microstrip antenna by incremental steps of 1.5 MHz.

6. The TM microstrip antenna of claim 1 wherein TM microstrip antenna has a maximum diameter of 10 inches, a thickness of 0.2 inches and a length of 8 inches.

7. The TM microstrip antenna of claim 1 wherein said first dielectric layer has a thickness of 0.062 inches, and said second dielectric layer and said third dielectric layer each have a thickness of 0.060 inches and are clad with one ounce copper.

8. A TM microstrip antenna adapted for use on a projectile comprising:

(a) first, second and third rectangular shaped 120-degree TM microstrip antenna elements mounted on an outer surface of said projectile adjacent to one another, each of said first, second and third 120-degree TM microstrip antenna elements including:

(i) a first dielectric layer operating as a protective layer for each of said 120-degree TM microstrip antenna elements;

(ii) a second dielectric layer positioned below said first dielectric layer within each of said 120-degree TM microstrip antenna elements, said second dielectric layer having an upper surface and a lower surface;

(iii) a rectangular shaped copper quarter wavelength resonator mounted on the upper surface of said second dielectric layer;

(iv) a continuous gap formed around one edge and two sides of said quarter wavelength resonator, said continuous gap being configured so that said TM microstrip antenna operates as a quarter wavelength microstrip antenna;

(v) a copper plated region formed outside of said gap on a remaining portion of the upper surface of said second dielectric layer, said copper plated region functioning as a ground for said quarter wavelength resonator;

(vi) a plurality of aligned tuning tabs mounted on the bottom surface of said second dielectric, each of said tuning tabs having a plated through via which passes through said second dielectric layer to said quarter wavelength resonator to connect said tuning tab to said quarter wavelength resonator;

(vii) a third dielectric layer positioned below said second dielectric layer within each of said 120-degree TM microstrip antenna elements, said third dielectric layer having an upper surface and a lower surface; and (viii) a copper plated ground plane mounted on the bottom surface of said third dielectric layer wherein said copper plated ground plane is connected to the copper plated region of said second dielectric layer grounding the copper plated region of said second dielectric layer; and (b) said first, second and third 120-degree TM microstrip antenna elements generating an omni-directional radiation pattern at the front and rear of said TM microstrip antenna at first and second operating frequencies;

(c) a power divider connected to said first, second and third 120-degree TM microstrip antenna elements, wherein said first, second and third 120-degree TM microstrip antenna elements are driven by equal amplitude signals provided to each of said first, second and third 120-degree TM microstrip antenna elements by said power divider; and (d) first, second and third transmission lines connecting said power divider to said first, second and third 120-degree TM microstrip antenna elements, said first, second and third transmission lines being configured to provide for a 120 degree progressive phase shaft of said equal amplitude signals wherein said first, second and third transmission lines have different lengths resulting in said 120 degree progressive phase shaft of said equal amplitude signals, said equal amplitude signals being progressively phase shifted by said 120 degree progressive phase shaft to obtain circular polarization of the electromagnetic filed generated by said TM microstrip antenna.

9. The TM microstrip antenna of claim 8 wherein said first operating frequency for said TM microstrip antenna is 241.2 MHz.

10. The TM microstrip antenna of claim 8 wherein said second operating frequency for said TM microstrip antenna is 231.0 MHz.

11. The TM microstrip antenna of claim 8 wherein the operating frequency for said TM microstrip antenna is tuned by selectively removing the plated through vias from said second dielectric layer for each of said first, second and third 120-degree TM microstrip antenna elements.

12. The TM microstrip antenna of claim 8 wherein selective removal of said tuning tabs from the quarter wavelength resonator for said first, second and third 120-degree TM microstrip antenna elements fine tunes said TM microstrip antenna by incremental steps of 1.5 MHz.

13. The TM microstrip antenna of claim 8 wherein TM microstrip antenna has a maximum diameter of 10 inches, a thickness of 0.2 inches and a length of 8 inches.

14. The TM microstrip antenna of claim 8 wherein said first dielectric layer has a thickness of 0.062 inches, and said second dielectric layer and said third dielectric layer each have a thickness of 0.060 inches and are clad with one ounce copper.

15. The TM microstrip antenna of claim 8 wherein said TM microstrip antenna has a Voltage Standing Wave Ratio (VSWR) of less than 2:1 over a 240.4 MHz to 242.0 MHz frequency range which is a result of isolating said power divider.

16. A TM microstrip antenna adapted for use on a projectile comprising:

(a) first, second and third rectangular shaped 120-degree TM microstrip antenna elements mounted on an outer surface of said projectile adjacent to one another, each of said first, second and third 120-degree TM microstrip antenna elements including:

(i) a first dielectric layer operating as a protective layer for each of said 120-degree TM microstrip antenna elements;

(ii) a second dielectric layer positioned below said first dielectric layer within each of said 120-degree TM microstrip antenna elements, said second dielectric layer having an upper surface and a lower surface;

(iii) a rectangular shaped copper quarter wavelength resonator mounted on the upper surface of said second dielectric layer;

(iv) a continuous gap formed around one edge and two sides of said quarter wavelength resonator, said continuous gap being configured so that said TM microstrip antenna operates as a quarter wavelength microstrip antenna;

(v) a copper plated region formed outside of said gap on a remaining portion of the upper surface of said second dielectric layer, said copper plated region functioning as a ground for said quarter wavelength resonator;

(vi) a plurality of aligned tuning tabs mounted on the bottom surface of said second dielectric, each of said tuning tabs having a plated through via which passes through said second dielectric layer to said quarter wavelength resonator to connect said tuning tab to said quarter wavelength resonator;

(vii) a third dielectric layer positioned below said third dielectric layer within each of said 120-degree TM microstrip antenna elements, said third dielectric layer having an upper surface and a lower surface; and (viii) a copper plated ground plane mounted on the bottom surface of said third dielectric layer wherein said copper plated ground plane is connected to the copper plated region of said second dielectric layer grounding the copper plated region of said second dielectric layer; and (b) said first, second and third 120-degree TM microstrip antenna elements generating an omni-directional radiation pattern at the front and rear of said TM microstrip antenna at a first operating frequency of 241.2 MHz or a second operating frequency of 232 MHz, wherein said TM microstrip antenna is tuned to said first operating frequency of 241.2 MHz or said second operating frequency of 232 MHz by selectively disconnecting said plurality of tuning tabs from the quarter wavelength resonator on each of said first, second and third 120-degree TM microstrip antenna elements which fine tunes said TM microstrip antenna by incremental steps of 1.5 MHz;

(c) a power divider connected to said first, second and third 120-degree TM microstrip antenna elements, wherein said first, second and third 120-degree TM microstrip antenna elements are driven by equal amplitude signals provided to each of first, second and third 120-degree TM microstrip antenna elements by said power divider; and (d) first, second and third transmission lines connecting said power divider to said first, second and third 120-degree TM microstrip antenna elements, said first, second and third transmission lines being configured to provide for a 120 degree progressive phase shaft of said equal amplitude signals wherein said first, second and third transmission lines have different lengths resulting in said 120 degree progressive phase shaft of said equal amplitude signals, said equal amplitude signals being progressively phase shifted by said 120 degree progressive phase shaft to obtain circular polarization of the electromagnetic filed generated by said TM microstrip antenna.

17. The TM microstrip antenna of claim 16 wherein TM microstrip antenna has a maximum diameter of 10 inches, a thickness of 0.2 inches and a length of 8 inches.

18. The TM microstrip antenna of claim 16 wherein said first dielectric layer has a thickness of 0.062 inches, and said second dielectric layer and said third dielectric layer each have a thickness of 0.060 inches and are clad with one ounce copper.

19. The TM microstrip antenna of claim 16 wherein said first, second and third dielectric layers for each of said first, second and third 120-degree TM microstrip antenna elements are gold plated to protect copper plating within said TM microstrip antenna from environmental conditions and high bonding temperatures.

20. The TM microstrip antenna of claim 16 wherein said TM microstrip antenna has a Voltage Standing Wave Ratio (VSWR) of less than 2:1 over a 240.4 MHz to 242.0 MHz frequency range which is a result of isolating said power divider.

* * * * *